US010287039B2

(12) United States Patent
Heyn

(10) Patent No.: US 10,287,039 B2
(45) Date of Patent: May 14, 2019

(54) INDUCTION HEAT SEALED CONTAINER CLOSURES

(71) Applicant: William M. Heyn, New Canaan, CT (US)

(72) Inventor: William M. Heyn, New Canaan, CT (US)

( * ) Notice: Subject to any disclaimer, the term of this patent is extended or adjusted under 35 U.S.C. 154(b) by 0 days.

(21) Appl. No.: 14/500,903

(22) Filed: Sep. 29, 2014

(65) Prior Publication Data

US 2016/0016681 A1 Jan. 21, 2016

Related U.S. Application Data

(60) Provisional application No. 61/999,237, filed on Jul. 19, 2014.

(51) Int. Cl.

| | |
|---|---|
| ***B65D 41/00*** | (2006.01) |
| ***B65B 7/28*** | (2006.01) |
| ***B65D 41/04*** | (2006.01) |
| ***B65D 41/16*** | (2006.01) |
| ***B65D 41/18*** | (2006.01) |
| ***B65B 51/22*** | (2006.01) |
| ***B65B 51/32*** | (2006.01) |

(52) U.S. Cl.

CPC ..... *B65B 7/2842* (2013.01); *B65B 51/227* (2013.01); *B65B 51/32* (2013.01); *B65D 41/045* (2013.01); *B65D 41/16* (2013.01); *B65D 41/18* (2013.01)

(58) Field of Classification Search

CPC ..... B65D 41/045; B65D 41/0457; B65D 41/0464; B65D 41/0471

See application file for complete search history.

(56) References Cited

U.S. PATENT DOCUMENTS 2,952,374 A * 9/1960 Pryale ..... B65D 41/0442 215/329
3,181,720 A * 5/1965 Cassie ..... B65D 1/0246 215/260
3,409,160 A * 11/1968 Scott ..... B65D 41/045 215/261
4,241,864 A * 12/1980 Kessler ..... B65D 15/08 215/233
4,645,087 A * 2/1987 Kusz ..... B65D 41/3438 215/254
4,668,458 A * 5/1987 Whitney ..... B65D 41/045 215/329

(Continued)

*Primary Examiner* — Ernesto Grano
(74) *Attorney, Agent, or Firm* — William H. Holt

(57) ABSTRACT

Container closures for bottles, cans, tubs, etc. having a sloping or slanted flange on the container which matches a complementary flange on a closure cap. The flange is disposed at an angle of at least 10 degrees and a preferred angle of about 20 degrees for a conventional 63 mm closure and a preferred width of about 0.125 to 0.175 inches. A foil liner carried by the cap includes an induction heat activated adhesive on at least the portion thereof facing the complementary flange on the container for greatly increasing burst, vacuum and drop impact strength of the container because the adhesion is in shear rather than peel. Provision can be made for facilitating peeling of the liner to assist the consumer in opening the container. The liner may additionally be adhered to a horizontal surface of the container for further securing the liner thereto.

14 Claims, 6 Drawing Sheets

(56) References Cited

U.S. PATENT DOCUMENTS 5,560,504 A * 10/1996 Molinaro ..... B65D 1/0246 215/224
5,971,183 A * 10/1999 Bartsch ..... B65D 43/0256 215/256
6,044,994 A * 4/2000 Miller ..... B65D 41/045 215/341
6,241,111 B1 * 6/2001 Sandor ..... B29C 49/50 215/252
6,260,722 B1 * 7/2001 Ekkert ..... B65D 41/0471 215/331
6,439,380 B1 * 8/2002 Welsh ..... A61C 5/066 206/219
7,611,026 B1 * 11/2009 Bloom ..... B65D 41/045 215/252
7,661,565 B2 * 2/2010 Jackman ..... B65D 51/20 215/232
7,766,178 B2 * 8/2010 Robinson ..... B65D 1/023 215/232
7,886,928 B2 * 2/2011 Mengeu ..... B65D 51/1644 220/324
8,056,744 B2 * 11/2011 Ekkert ..... B65D 41/0414 215/344
8,100,277 B1 * 1/2012 Bush ..... B65D 41/045 215/305
8,353,413 B2 * 1/2013 Ekkert ..... B65D 41/0485 215/252
8,376,164 B2 * 2/2013 Perrin ..... B65D 41/0428 215/341
2006/0255004 A1 * 11/2006 Shingle ..... B65D 50/045 215/332
2009/0184082 A1 * 7/2009 Antier ..... B65D 51/228 215/216
2010/0282707 A1 * 11/2010 Granger ..... B21D 51/46 215/329

* cited by examiner

INDUCTION HEAT SEALED CONTAINER CLOSURES

This is a continuation-in-part of PCT/US2014/11171, filed on Jan. 11, 2014 in the USPTO Receiving Office which claims priority of U.S. Provisional Application 61/768,381, filed Feb. 22, 2013 for which priority is claimed. Priority is also claimed for U.S. Provisional Application 61/999,237, filed Jul. 19, 2014. The disclosures of the foregoing are incorporated herein by reference.

BACKGROUND OF THE INVENTION

It has previously been disclosed to provide flexible closures for containers wherein the burst strength, internal vacuum resistance, and drop impact strength are increased by placing seals in shear without increasing the peel forces needed for consumers to open the closures and thereby gain access to the contents in the container.

SUMMARY OF THE INVENTION

A primary feature of the present disclosure is to disclose a range of preferred flange angles and widths of seals used to form a seal between the closure and the container on an angled flange, or finish, of the closure and the container rather than merely sealing on a top edge or surface of the container as is presently done. The result is a much stronger seal which is in shear rather than peel.

The improved burst performance of angled seals is documented in results of lab tests described here:

Burst Tests: Heat Seal in Shear (Angled) vs. Peel (Flat)
307 Diameter Plastic Bowls with Sealing Film, Heat Sealed to the Flange
Standard Plant Air

| Test Results:** | PSI | |
|---|---|---|
| Variable (Flange Angle) | Average Burst | Burst Range |
| Flat (Control) | 26 | 18-32 |
| 30 Degree Angle | 45 | 41-55 |
| 45 Degree Angle | 56 | 53-65 |

To achieve the time, temperature and pressure needed in the process, an angled section under, and at the outer, internal edge of the closure is added. The shape of this section can vary depending upon the geometry of the container flange but is intended, in all cases, to exert pressure on the angled liner and container flange as the closure is twisted or snapped into place.

While the angle section is generally around the entire inner corner or circumference, 360 degrees of the closure, some designs change the shape, or reduce the angle, over a small section to prevent a full section heat seal on the periphery to facilitate a pull tab, or peel opening feature. This technique of providing a pull tab helps to initiate the peel opening, and also reduces tearing of the liner or of the lid when opened from the outside by a consumer. The force needed to peel the pull tab is, ideally, in the range of 2 to 6 pounds. The necessary force could be higher, on the order of 10 to 12 pounds, but that risks tearing of the liner or inducing the consumer to use a sharp instrument to tear the liner for opening the container.

All current liners are flat and are pushed into the closure as a component, or are cut from a web of liner material and pressed into the closure. The liner contemplated by the present invention may also be flat and may be inserted into the closure the same as with existing liners. Or, the liner may be preformed before insertion into the closure. Preforming has two advantages. First, since the outside diameter of an angled liner could well be greater than flat liners, preforming would allow clearance past the closure threads or snap ring as the liner is being inserted. Second, because of a requirement to angle the full periphery of the liner, preforming would avoid wrinkles which could impede effective seals.

Those skilled in the container and packaging art will recognize that the invention is suitable for use with the three different types of closure caps, namely, (1) push on—push off, (2) twist on—twist off, and (3) push on—twist off. Thus, the container closures and/or the containers can be provided with helical threads, or with circumferential snap rings.

A major trend in the container industry is to blow the bottle finish into the mold rather than use an injection molded finish. Injection has been used in the early days where finish diameters were small (such as with soft drinks) and the small diameter allowed more parisons per mold. Now, especially with bigger diameters (such as 63 mm) the finishes are blown and the injection molded top of the preform is cut off and recycled as plant scrap. The net impact is thinner top finishes which are harder to seal effectively. Therefore, adding the angled flange gives a good sealing surface and adds the shear feature, rather than peel, if angled correctly.

BRIEF DESCRIPTION OF THE DRAWINGS

FIG. 7 illustrates a modified form of the invention wherein the container flange is provided with a horizontal, flat sealing surface and a downwardly and outwardly slanted sealing surface cooperating with matching surfaces on the container cap for securing an outer periphery of a liner there between.

Figure 15:
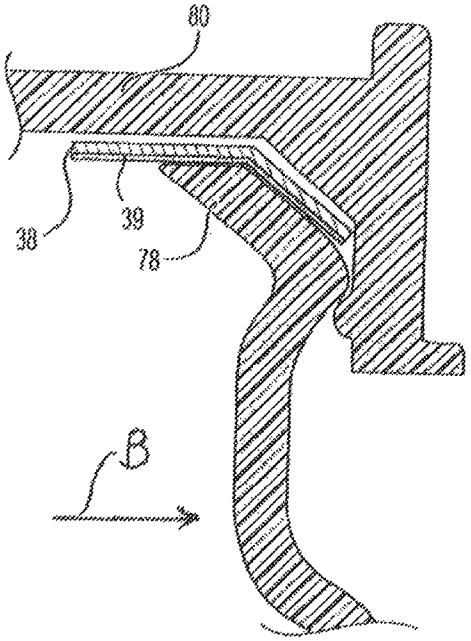
FIG. 15 illustrates a "Push-On, Push-Off" closure cap with a liner that is induction heat-sealed to the slanted finish of a container.
Figure 14:
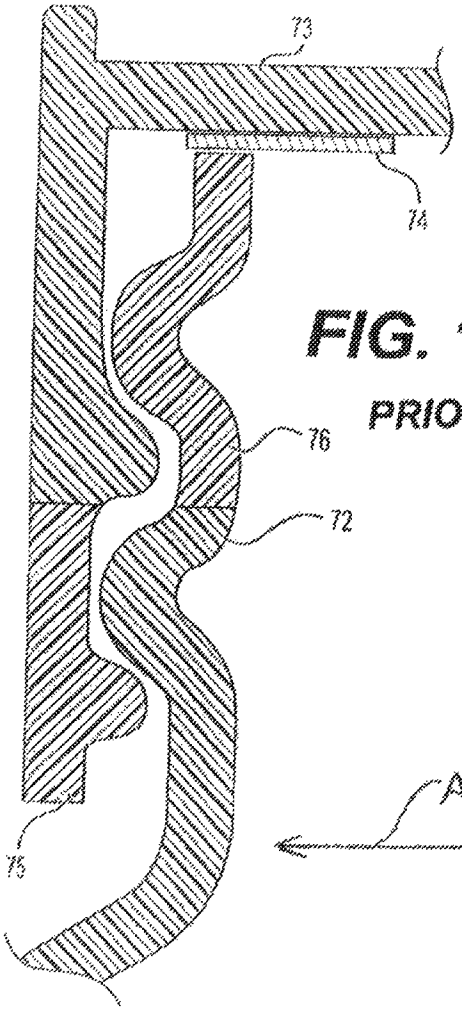
FIG. 14 PRIOR ART
FIG. 14 depicts an "Existing", or "Prior Art" example of a traditional "twist-on, twist-off" threaded cap and conventional flat liner.

The lines A and B shown on FIGS. 14 and 15 represent the identical fill level for both designs of finish and closures.

Figure 16:
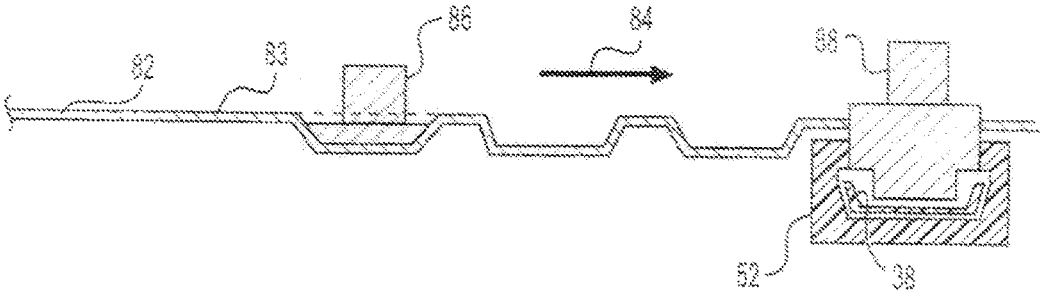
Figure 17:
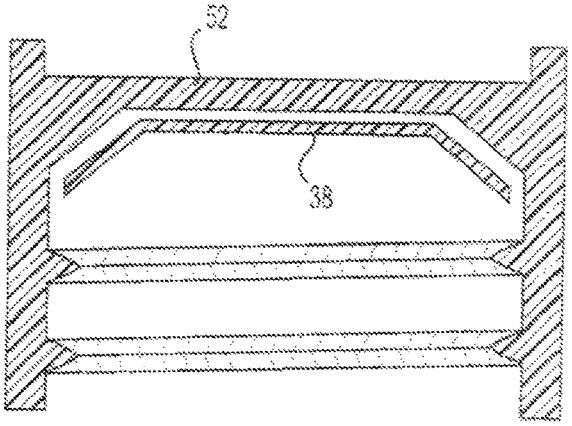

FIG. 16 is a fragmentary showing of a production line for inserting liners into a closure cap of the type shown in FIG. 17.

FIG. 17 shows a modified container closure having a slanted surface for cooperating with a slanted surface of a liner and the container finish, and being provided with screw threads for attaching the closure cap to a container.

Figure 18:
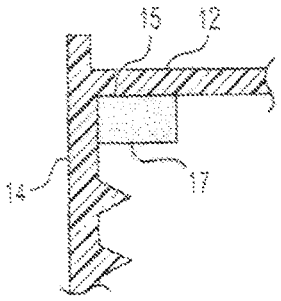
FIG. 18 PRIOR ART

FIG. 18 illustrates a prior art closure cap wherein the top of the cap and the side wall of the cap are joined at a right angle corner and a flat, molded annular gasket is located at the corner.

Figure 19:
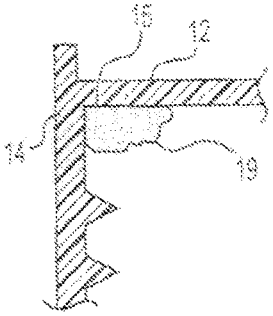
FIG. 19 PRIOR ART

FIG. 19 is a further example of a prior art closure cap joined at a right angle corner, and a gasket of moldable resilient material is applied within the corner.

Figure 20:
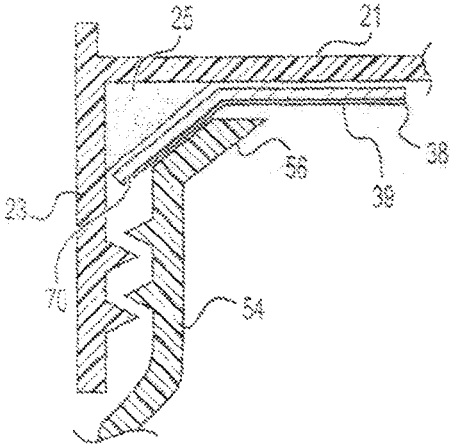

FIG. 20 is a fragmentary section of a novel form of closure cap wherein the top and side wall of the cap are joined at an angle, similar to FIG. 17, and a moldable resilient material forms a gasket that conforms under pressure to an angled surface of the container.

Figure 21:
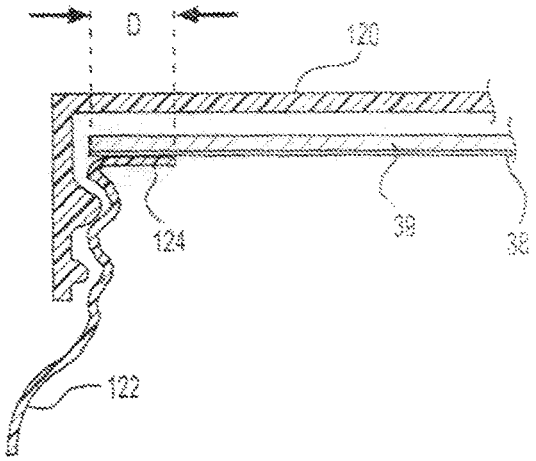

FIG. 21 is a fragmentary section of a blow molded container and a closure cap wherein the container terminates at its open end with a horizontal, inwardly directed flange.

DESCRIPTION OF THE PREFERRED EMBODIMENTS

Figure 1:
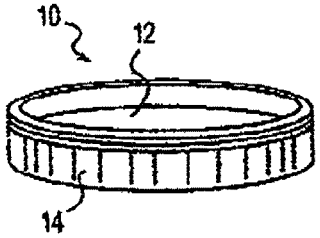
FIG. 1 PRIOR ART
FIG. 1 is a perspective view of a prior art closure cap for closing a container.

FIG. 1 is a perspective view of a closure member also referred to as a cap or lid known in the prior art, generally indicated by the numeral 10, and includes a central end closure panel 12 and a depending skirt portion 14 for closing a conventional container, such as a metal, glass or plastic can or bottle.

Figure 2:
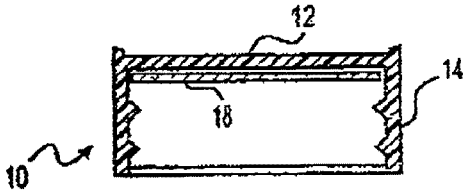
FIG. 2 PRIOR ART
FIG. 2 is a vertical section of the prior art closure cap of FIG. 1 and shows a liner contained therein.

FIG. 2 is a vertical section of the prior art closure member 10 of FIG. 1 and illustrates a series of internal threaded portions 16 which can be used for pushing on, and twisting off the closure member 10, and includes a flat liner 18—which may be made of paper, foil or plastic or be multilayer—underlying the central end closure panel 12.

Figure 3:
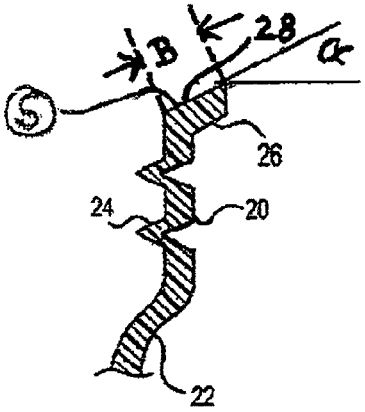
FIG. 3 is a fragmentary section of a container provided with an inwardly turned top flange portion having a slanted engagement surface having an angle $\alpha$.

FIG. 3 shows a fragmentary, vertical, upper container section 20 of a container 22 which is provided with an external, helical threaded portion 24. It is to be understood that a snap ring can be used in lieu of helical threads. A tongue member or flange 26 extends upwardly and inwardly at the uppermost portion of top section 20 and includes a slanted, non-horizontal, upper surface 28 which extends circumferentially about the container 22. The slanted upper surface 28 is shown slanted at a flange angle $\alpha$ and having a width B. This flange angle for a well known standard 63 millimeter (mm) closure can be in a range of preferably at least about 10 degrees to about 50 degrees, more likely in a range of 15-25 degrees, and preferred at about 20 degrees, plus or minus up to 5 degrees. For larger containers this flange angle can and should be increased to an angle in the range of 25 to 50 degrees. The width B of the flange 28 is in the range of about 0.050 to 0.250 inches with a preferred width of about 0.125 to 0.175 inches.

Slanted upper surface 28 comprises a circumferentially extending, slanted, flat sealing surface identified by the letter "S".

Figure 4:
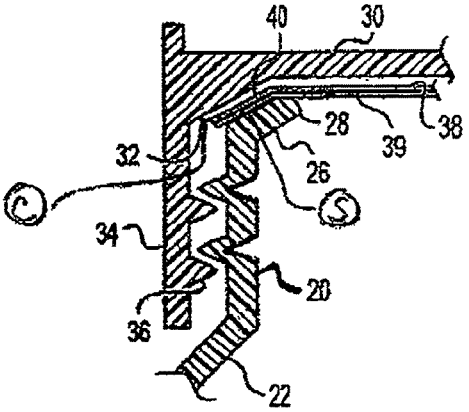
FIG. 4 illustrates the fragmentary section of FIG. 3 positioned within a closure cap that is provided with a matching slanted engagement surface for capturing a peripheral portion of a liner along the slanted flange portion of the container.

FIG. 4 shows a novel container closure, lid or cap member 30 including a non-horizontal, circumferential, slanted surface 32 which cooperates with the slanted, upper surface 28 on the tongue member 28 of container 22. Closure 30 has a skirt portion 34 which may include internal thread or threads 36 for adapting closure 30 to be threaded onto, or pushed on and twisted off, the top portion 20 of container 22. A liner 38 includes a thin layer of heat-sensitive adhesive 39 on the underside thereof that comes into contact with the slanted surface 28 of the tongue 26 on the top section 20 of the container 22. Liner 38 is preferably of metal foil and the underlying, thin layer of adhesive 39 is heat sensitive such that during closure of the container, induction heating causes the adhesive 39 to seal the liner 38 to the slanted surface 28 on the container 22. As is shown in FIG. 4, a peripheral portion 40 of liner 38 is disposed between the slanted surface 28 of tongue 26 and the slanted surface 32 on the underside of closure member 30. While the parts are shown partly separated for clarity, it is to be understood that when tightly assembled by threads 24 and 36, liner 38 has its peripheral portion 40 tightly pressed against slanted surface 28. While the slanted surfaces 28 and 32 are shown as having flat, or planar, surfaces, it is to be understood that one surface may be slightly domed and the other surface slightly concave thereby having a smooth even grip on the peripheral portion 40 of liner 38. After filling and sealing, when the closure member 30 is removed during opening of the container 22, the liner 38 is adhered in shear rather than peel, and the consumer's opening motion is in peel.

The circumferentially extending, slanted, flat surface 32 comprises a clamping surface identified by the letter "C" for clamping the line 38 against the sealing surface 28 of the container 22.

Figure 5:
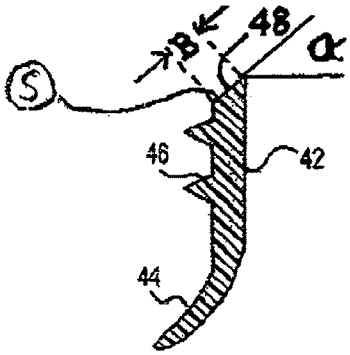
FIG. 5 illustrates a modification of the top portion of a container wherein a downwardly and outwardly slanted surface is provided having an angle $\alpha$.
Figure 6:
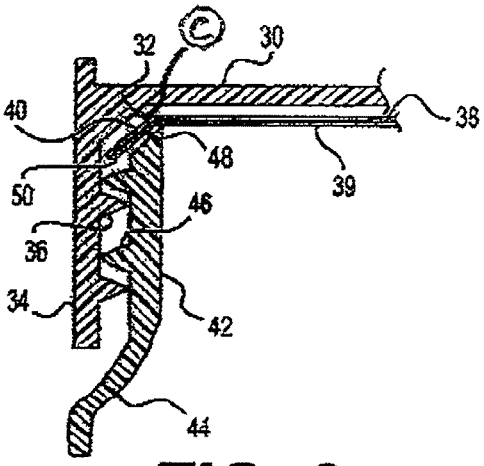
FIG. 6 illustrates the fragmentary section of FIG. 5 positioned within a closure cap that is provided with a matching slanted engagement surface for capturing a peripheral portion of a liner along the slanted flange portion of the container, with an outermost portion of a liner for providing a pull tab aiding a consumer in removing the liner from the container after removal of the closure cap.

FIGS. 5 and 6 show an upper container section 42 of a container 44 having exterior threads 46. Container 44 may be formed of plastic, glass or metal, and at its uppermost portion, or finish, is topped with a non-horizontal, slanted surface 48. In a manner similar to FIG. 3, slanted surface 48 forms a flange angle $\alpha$ which for the standard 63 mm closure has the same ranges described above with the preferred angle being about 20 degrees, plus or minus a couple of degrees. Slanted surface 48 has a width B in the range of 0.050 to 0.250 inches and a presently preferred width of about 0.125 to 0.175 inches for a 63 mm closure. As is shown in FIG. 6, a peripheral portion 40 of liner 38 is disposed between slanted surface 32 of closure 30 with the heat-sensitive adhesive side 39 disposed for contact with slanted surface 48 of container 44. During closure of container 44, closure 30 presses the peripheral portion 40, of liner 38, against slanted surface 48, and induction heat is applied for causing adhesive 39 to secure liner 28 to slanted surface 48. When the closure member 30 is removed during opening of the container 44, the liner 38 is adhered in shear rather than peel. It is shown in FIG. 6 that the peripheral portion 40, of liner 38, includes an over-hanging portion forming a pull tab 50 for assisting a consumer in opening the container 44 by peeling liner 38 from container 44.

Figure 7:
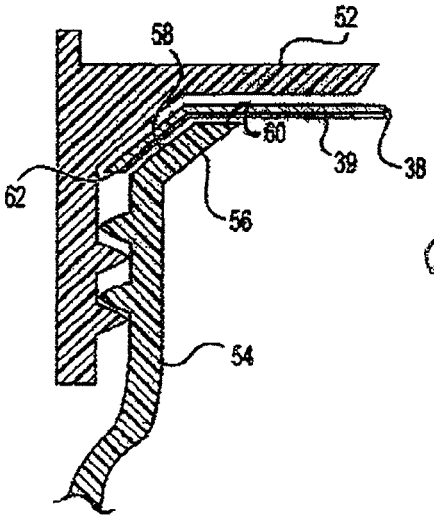

FIG. 7 illustrates a different embodiment of a closure, cap or lid 52, and container 54 wherein an inwardly sloping container tongue 56 includes a slanted surface 58 and flat upper surface 60 for increasing the area of contact with the peripheral portion of liner 38. A portion 62 of liner 38 overhangs the tongue 56 to provide a pull tab for assisting a consumer to peel the liner 38 from container 54 after the closure 52 is removed.

Figure 8:
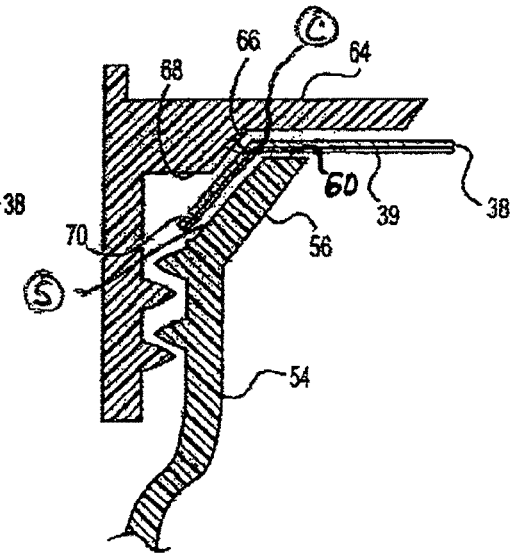
FIG. 8 illustrates another modified form of the invention wherein the container flange is provided with a horizontal, flat sealing surface and a downwardly and outwardly slanted sealing surface cooperating with surfaces on the container cap for securing an outer periphery of a liner there between wherein the slanted surface on the closure cap is foreshortened to avoid sealing a pull tab portion of the liner against the container flange.

FIG. 8 is similar to FIG. 7 but includes a closure 64 having a shortened slanted surface 66 and a horizonal flat portion 68 such that a peripheral portion 70 of the liner 38 is free of the tongue 56 to provide a pull tab. It is to be understood that the flat portion 68 may only extend about 10 degrees about the circumference of container 54.

Figure 9:
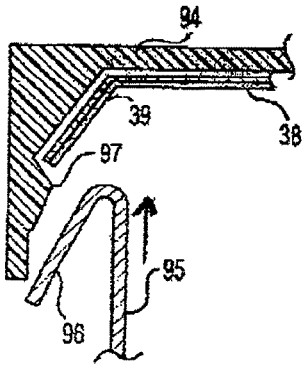
FIG. 9 illustrates a modified snap-on closure cap and a modified container flange with an externally turned and downwardly angled surface matched or slightly greater angle than a corresponding angle on the underside of the cap and liner.
Figure 10:
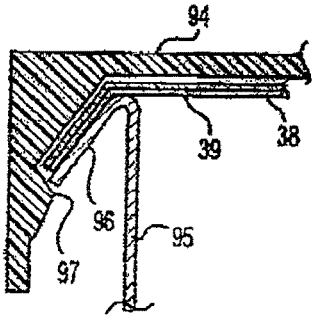
FIG. 10 shows the closure cap and container of FIG. 9 in a closed position wherein the peripheral portion of a liner is captured between the closure cap and an outwardly and downwardly sloping surface of the container.

FIG. 9 shows a modified closure 94 and a liner 38 having complementary outwardly and downwardly slanted surfaces. As previously described, liner 38 has a thin layer of adhesive on the side thereof that comes into contact with the related container. A container 95, which may be formed of metal, paper or plastic, has an outwardly and downwardly extending flange 96 which comes into contact with liner 38 when pressed together as indicated by the arrow in FIG. 9, and as shown in FIG. 10. Closure 94 has an inwardly extending cam surface 97 which deflects container flange 96 inwardly during assembly and the flange 96 then snaps into contact with liner 38 as is shown in FIG. 10. The parts are shown slightly spaced for clarity but it is to be understood that the flange 96 and liner 38 are in firm contact with each other during the step of induction heating for sealing the container 95 with the adhesive layer 39 of liner 38.

Figure 11:
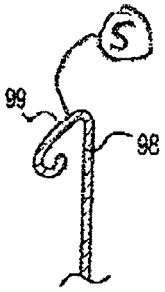
FIG. 11 illustrates a modified flange on a container, which may be formed of metal, the edge portion being curled for avoiding a hazardous sharp edge.

FIG. 11 is a fragmentary portion of a modified metal container 98 having an outwardly and downwardly slanted flange 99 which is intended to cooperate with the closure 94, as in FIGS. 9 and 10. Flange 99 terminates in a curl to protect against a sharp peripheral edge.

Figure 12:
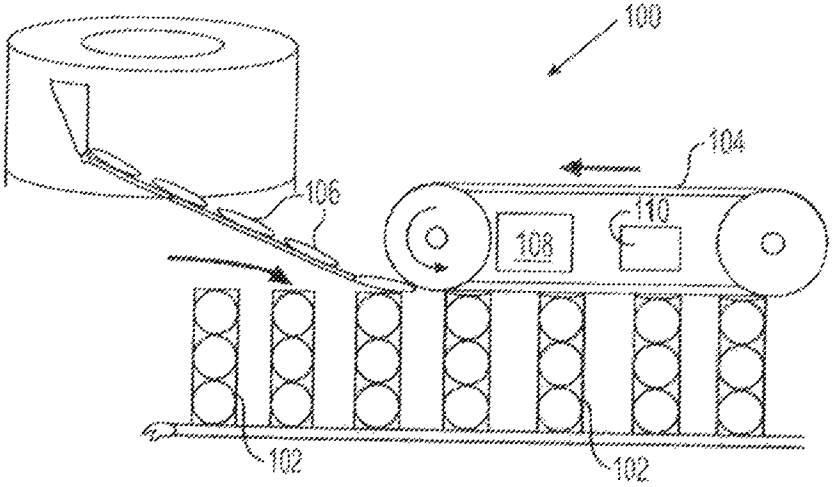
FIG. 12 shows apparatus for providing a sealing line for closing a plurality of containers with an opposing conveyor belt to snap the closure onto the container and hold it while an induction heating device and a cooling device create the sealing process.

FIG. 12 shows a closing line, generally indicated by the numeral 100, wherein a plurality of containers 102 are shown moving under a conveyor belt 104 for pressing caps 106 onto the containers 102 and holding them together while an induction heater 108 causes adhesive on the liner contained within the cap 106 to seal the container 102. The adhesive can then be cooled by a cooling unit 110.

Figure 13:
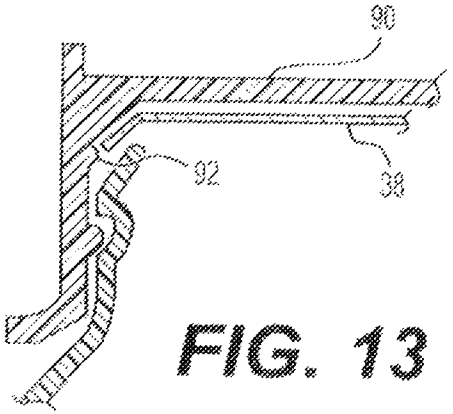
FIG. 13 is a fragmentary, sectional view of a closure cap which includes a small circumferential ring member for engaging the peripheral edge of a liner for centering and hold the liner in place prior to closing of the container with the closure cap. The closure in FIG. 13 is snapped in place instead of relying on threads.

FIG. 13 shows a further modification wherein a closure, cap or lid 90 includes a ring or series of nibs 92 extending circumferentially about the underside of closure 90 for being contacted by the peripheral edge of liner 38 to center the liner 38 and maintain it in proper position while the closure is placed upon a container during the closing operation.

FIG. 14 illustrates an existing, prior art, traditional threaded container 72, threaded closure 73 and liner 74. In accord with the present invention, it is seen that a bottom part of the circumferential, tamper-band skirt 75 is to be eliminated because tamper evidence is provided by the aluminum sealed liner; also eliminated is an upper part of the container finish 76. The result is shown in FIG. 15 wherein liner 38 has its adhesive side 39 heat sealed to a container tongue 78 and closure 80 is a "Push-On, Push-Off" closure. The weight reduction of the container finish 76 is approximately 5 grams for a container of 63 mm finish and the closure skirt portion 75 is also a meaningful change resulting in significant cost savings.

The lines A and B shown on FIGS. 14 and 15 represent the identical fill level for both designs of finish and closures. The savings in material through utilizing the closure cap and container of FIG. 15, rather than the prior art structures of FIG. 14, is economically meaningful.

FIG. 16 is a fragmentary showing of a production line for preforming liners 38 from a web of liner material 82 that on its upperside is coated with a thin layer of adhesive 83. Web 82 moves in the direction of arrow 84 and passes beneath a forming tool 86 which shapes the outline of a desired liner 38. The web 82 continues and is acted upon by a punch 88 that inserts liner 38 into an underlying closure 52 first shown in FIG. 7 and shown in cross section in FIG. 17. It is to be understood that the same procedure may be used for inserting a liner 38 into closures 30, 52, 64, 80, 90 and 94 described above.

FIGS. 18 and 19 are both examples of prior art closures wherein the end panels wherein the central end panel closures 12 are joined to depending skirt portions 14 at right angles 15. In the embodiment of FIG. 18 there is provided a preformed gasket 17, generally rectangular in section, that extends circumferentially about the skirt 14. In the embodiment of FIG. 19, a gasket 19 of moldable resilient material is applied within the right angle corner where the end panel closure 12 meets the skirt portion 14.

FIG. 20 is an improvement over the embodiments of FIGS. 18 and 19. A gasket 25 of moldable resilient material is provided where the end panel 21 meets with the depending skirt portion 23. In view of the tapered tongue 56 on the container 54, similar to the showing in FIG. 8, the gasket 25 is caused to conform to the tapered tongue 56 and capture and press a peripheral portion of liner 38 and place it in shear. A pull tab 70 assists the consumer in initially pealing the liner from the container 54.

FIG. 21 illustrates a closure cap 120 for a blow molded container 122 having a substantially horizontally, plus or minus 5 degrees, inwardly, extending flange 124. Closure cap 120 holds liner 38 against flange 124 during induction heating for causing adhesive 39 to secure the liner 38 to flange 124. This embodiment of the invention is useful for vacuum packed products wherein liner 38 tends to be drawn into the container 122 but is securely held, in shear, to the top surface of flange 124.

FIG. 21 also illustrates a feature of the invention with respect to the width of the container flanges and the sealing area between the respective liners 38 and adhesive layer 39 of the various disclosed embodiments. The dimension D in FIG. 21 may be in the range of 0.050 to 0.250 inches, or wider for larger containers. For the well known standard 63 mm closure, the width of dimension D may typically be in the range of about 0.125 to 0.250 inches and a presently preferred width of about 0.175 inches. For larger closures, the width of dimension D would likely be increased. These dimensions are suitable for hot packed or retorted product, or for vacuum packed products, and maintains the liners adhered to the container flanges in shear condition.

Modifications and variations as would be apparent to those skilled in the art are deemed to be within the scope of the present invention as defined by the appended claimed subject matter.

I claim:

1. A combination of a container for a product, a closure cap used for closing said container, and a liner for sealing said container;

said container having an open end and having a circumferentially extending, slanted flange, said circumferentially extending, slanted flange providing a flat sealing surface extending at an angle to the horizontal from said open end of said container;

said container is comprised of a tubular wall, said circumferentially extending, slanted flange being turned for forming an angle with said tubular wall, said sealing surface having a length greater than the thickness of said tubular wall;

said closure cap comprising an end panel and a skirt portion joined with and depending from said end panel and having an integral, circumferentially extending, slanted, flat, clamping surface complementary to said sealing surface;

said liner having a peripheral portion captured between said integral, circumferentially extending, slanted, flat clamping surface and said flat sealing surface;

and means for sealing said peripheral portion of said liner to said flat sealing surface of said container; wherein said means for sealing said peripheral portion of said liner to said flat sealing surface of said container includes a layer of heat sensitive adhesive on an underside of said liner located between said liner and said flat sealing surface for adhering to said sealing surface.

2. The combination as defined in claim 1 wherein said flat sealing surface has a length preformed in a range of 0.025 to 0.250 inches.

3. The combination as defined in claim 1 wherein said angle is in the range of 10 degrees to 50 degrees, said clamping surface and said flat sealing surface extending upwardly and inwardly from said open end of said container.

4. The combination as defined in claim 3 wherein said angle is 20 degrees plus or minus about 5 degrees.

5. The combination as defined in claim 1 wherein said clamping surface and said sealing surface are slanted outwardly and downwardly from said open end of said container to between about 10 to 80 degrees.

6. The combination as defined in claim 1 wherein at least said peripheral portion of said liner is composed of metal foil and includes a heat sensitive adhesive material on an underside of said liner.

7. The closure cap and container as defined in claim 1, said closure cap including an end panel and a skirt portion joined to and circumscribing said end panel and depending therefrom, said closure cap having an integrally molded, slanted, non-horizontal, substantially flat surface on an underside of said end panel adjacent to where said skirt portion is joined to said end panel, said integrally molded, slanted, non-horizontal, substantially flat surface being slanted about 10 degrees to about 80 degrees from the horizontal from said end panel and extending about an interior periphery of said container cap wherein said integral, circumferentially extending, slanted, flat, clamping surface is further defined as being integrally molded and non-horizontal to an underside of said end panel adjacent to where said skirt portion is joined to said end panel and is slanted between 10 degrees to 80 eighty degrees from the horizontal from said end panel and extending about an interior periphery of said container cap.

8. The combination as defined in claim 1 wherein said sealing surface has a length preformed in a range of 0.025 to 0.250 inches; and wherein said angle is in the range of about 10 degrees to 50 degrees extending upwardly and inwardly from the horizontal and from said open end of said container.

9. The combination as defined in claim 1 wherein said sealing surface has a length preformed in a range of 0.025 to 0.250 inches; and wherein said angle is in the range of about 10 degrees to 80 degrees extending downwardly and outwardly from the horizontal and from said open end of said container.

10. The combination as defined in claim 1 wherein said clamping surface of said closure cap and said sealing surface of said container are complementary and disposed at similar angles for mutually engaging said liner on opposite sides thereof.

11. The combination as defined in claim 1 wherein said means for sealing comprises at least said sealing surface of said container and includes a metal surface of said container for reaching sealing temperature when exposed to induction heat.

12. The combination as defined in claim 1 of a container for a product and a closure cap used for closing said container;

said container being formed of metal and said closure cap being formed of thermoplastic material;

said container having a sealing surface extending at an angle from said open end of said container;

said sealing surface having a length preformed in a range of 0.025 to 0.250 inches; and said closure cap having a complementary clamping surface, and wherein said angle is in the range of about 10 degrees to 80 degrees extending downwardly and outwardly from said open end of said container.

13. The combination as defined in claim 1 wherein said flange is turned inwardly from said container wall.

14. The combination as defined in claim 1 wherein said flange is turned outwardly from said container wall.

* * * * *